US008277078B2

(12) United States Patent
Tanaka

(10) Patent No.: US 8,277,078 B2
(45) Date of Patent: Oct. 2, 2012

(54) LIGHT EMITTING DEVICE

(75) Inventor: Kenichiro Tanaka, Neyagawa (JP)

(73) Assignee: Panasonic Corporation, Osaka (JP)

( * ) Notice: Subject to any disclaimer, the term of this patent is extended or adjusted under 35 U.S.C. 154(b) by 49 days.

(21) Appl. No.: 13/081,852

(22) Filed: Apr. 7, 2011

(65) Prior Publication Data

US 2011/0249431 A1 Oct. 13, 2011

(51) Int. Cl.
*F21S 19/00* (2006.01)

(52) U.S. Cl. ..... 362/227; 362/228; 362/231; 315/291; 315/294; 315/312; 315/292

(58) Field of Classification Search ..... 362/227, 362/228, 230, 231; 315/291, 292, 294, 312
See application file for complete search history.

(56) References Cited

U.S. PATENT DOCUMENTS 4,825,150 A * 4/1989 Sirasud ..... 324/133
2004/0246742 A1 12/2004 Toyota et al.
2006/0202915 A1 9/2006 Chikugawa
2009/0275216 A1* 11/2009 Nordin et al. ..... 439/49
2010/0066258 A1 3/2010 Yasuda

FOREIGN PATENT DOCUMENTS

JP 2004-363061 A 12/2004
WO 2008/137839 11/2008

OTHER PUBLICATIONS

The extended European search report dated Apr. 17, 2012.

* cited by examiner

*Primary Examiner* — Ali Alavi
(74) *Attorney, Agent, or Firm* — Bacon & Thomas, PLLC

(57) ABSTRACT

A light emitting device includes: a light source unit which has a first and a second LED which are connected in parallel and emit lights of different colors, respectively. The lights of the first and the second LED are mixed to provide an emission light of the light source unit when an operating voltage is applied. The light source unit further has a resistor which is connected in series to the first LED to make forward current changing characteristics of the first and the second LED depending on change in the operating voltage to be different from each other, so that a required luminous flux-color temperature property, in which change in a color temperature of the emission light is made to depend on change in a luminous flux of the emission light, is obtained while the first and the second LED are turned on by applying the operating voltage.

6 Claims, 3 Drawing Sheets

LIGHT EMITTING DEVICE

FIELD OF THE INVENTION

The present invention relates to a light emitting device that includes a light emitting diode (LED) as a light source.

BACKGROUND OF THE INVENTION

Recently, an LED which has low power consumption and a long lifespan draws great attention as a noticeable light source is used as a light source in lieu of the incandescent lamp of the conventional illuminating device. Among light emitting devices using LEDs as their light sources, there is a light emitting device employing LEDs that emit different colors of light, so that such LEDs emit color-mixed light as emission light (see, e.g., JP2004-363061A, paragraphs 0020 to 0022). In the light emitting device (an illumination device) disclosed in JP2004-363061A, the proportions of currents supplied to the respective LEDs of different colors can be varied to change the intensity ratios of the lights emitted from the LEDs of different colors, thereby selectively setting the color temperature. Also, JP2004-363061A discloses that brightness is adjusted without changing the color temperature by maintaining the set current proportions.

SUMMARY OF THE INVENTION

However, LED's color temperature change property depending on luminous flux change (luminous flux-color temperature property) is different from that of an incandescent lamp. Specifically, the LED's color temperature is almost uniform even when the luminous flux changes, whereas the typical incandescent lamp's color temperature increases as the luminous flux increases.

In JP2004-363061A, the color temperature is almost uniform when the luminous flux changes although the color temperature may be freely set. Hence, if an incandescent lamp and a light emitting device using an LED are employed together in a same place, the color temperature of the LED may be different from that of the incandescent lamp even when the same luminous flux has been set to the LED and the incandescent lamp. Therefore, one may feel the sense of incongruity thereby. If the light emitting device is turned on by a dimmer switch capable of controlling brightness, the luminous flux-color temperature property of the LED and the incandescent lamp become considerably different upon dimming.

SUMMARY OF THE INVENTION

In view of the above, the present invention provides a light emitting device using an LED as a light source and having a luminous flux-color temperature property of incandescent lamps, in which the color temperature varies depending on change in luminous flux.

In accordance with an aspect of the present invention, there is provided a light emitting device having: a light source unit which has a first and a second light emitting diode (LED) which are connected in parallel to each other and emit lights of different colors, respectively, wherein the lights of the first and the second LED are mixed to provide an emission light of the light source unit when an operating voltage is applied, and wherein the light source unit further has a resistor which is connected in series to the first LED to make forward current changing characteristics of the first and the second LED depending on change in the operating voltage to be different from each other, so that a required luminous flux-color temperature property, in which change in a color temperature of the emission light is made to depend on change in a luminous flux of the emission light, is obtained while the first and the second LED are turned on by applying the operating voltage.

The color temperature of the second LED may be higher than that of the first LED so that the color temperature of the emission light of the light source unit increases as the emission light becomes brighter.

The first and the second LED preferably emit a red and a white light, respectively.

Among the first and the second LED, an LED having a lower color temperature preferably has a lower turn-on voltage than the other LED having a higher color temperature.

In accordance with the aspect of the present invention, even when an LED is used as a light source, the luminous flux-color temperature properties of incandescent lamps, in which the color temperature of the emission light is changed depending on change in luminous flux of the emission light, can be achieved.

BRIEF DESCRIPTION OF THE DRAWINGS

The objects and features of the present invention will become apparent from the following description of embodiments, given in conjunction with the accompanying drawings, in which.

DETAILED DESCRIPTION OF THE EMBODIMENTS

Hereinafter, an embodiment of the present invention will be described in detail with reference to the accompanying drawings which form a part hereof.

Embodiment 1

Figure 1:
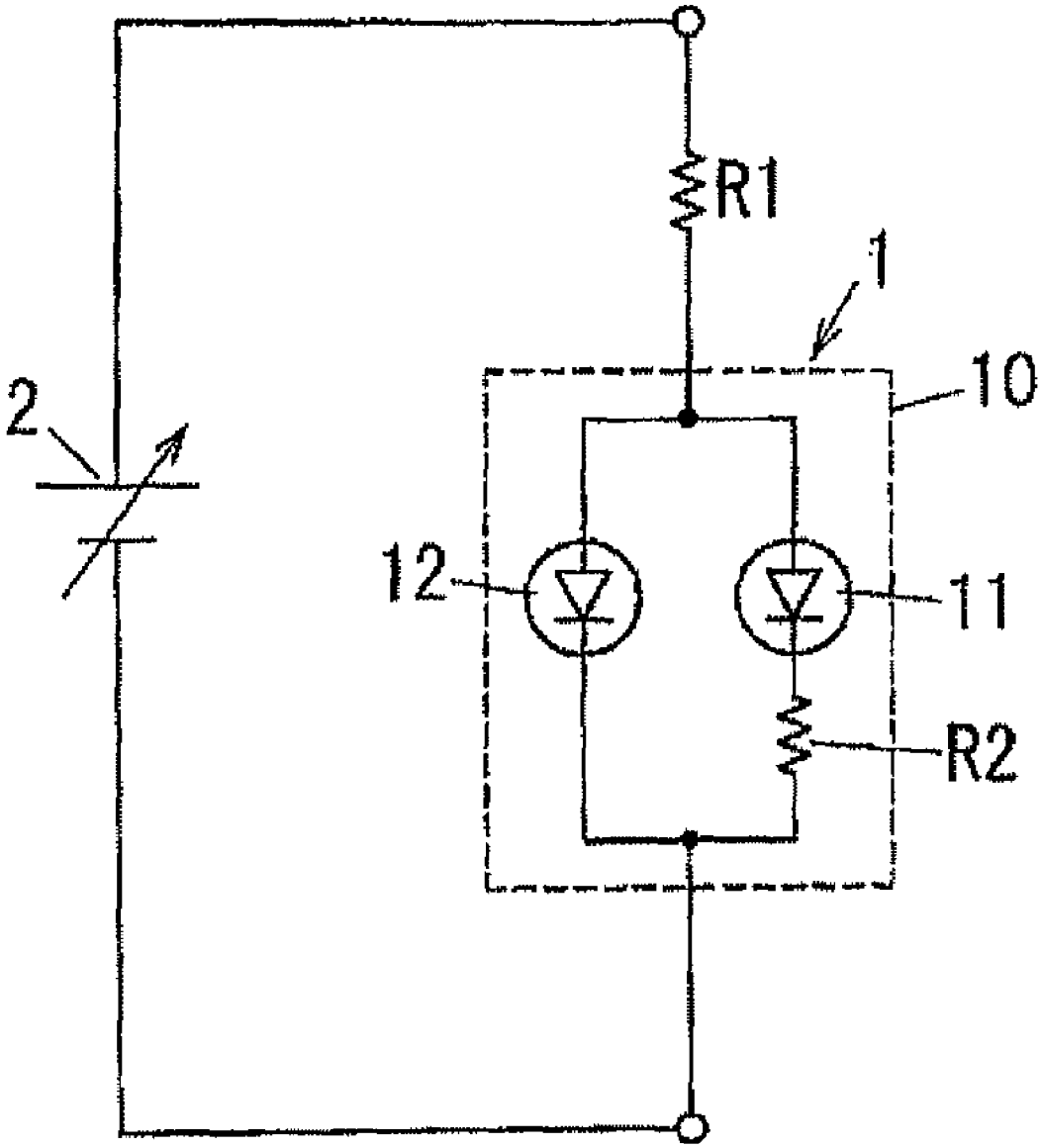
FIG. 1 is a schematic circuit diagram showing the configuration of light emitting device in accordance with an embodiment of the present invention.

In accordance with the embodiment of the present embodiment, a light emitting device 1 includes a light source unit 10 connected to output terminals of a power supply 2 outputting direct-current (DC) voltage, as shown in FIG. 1.

The light source unit 10 has a first and a second LED 11 and 12 that emit lights of different colors. The light source unit 10 is configured such that the first and the second LED 11 and 12 are disposed adjacent to each other, whereby color-mixed light of the first and the second LED 11 and 12 is obtained as an emission light. In order to mix the lights from the LED 11 and the LED 12, a light guide or the like may be used.

The first and the second LED 11 and 12 are connected in parallel to each other between the output terminals of the power supply 2. Also, a current limiting resistor R1 is interposed between the parallel circuit of the first and the second LED 11 and 12 and an output terminal of the power supply 2. Accordingly, when a DC voltage (operating voltage) is applied to the light source unit 10 from the power supply 2, forward current flows to each of the first and the second LED 11 and 12 via the current limiting resistor R1, so that both the LEDs 11 and 12 are turned on. Although the light source unit 10 having a single first LED 11 and a single second LED 12 is being described for the present embodiment, the light source unit 10 may have a plurality of first LEDs 11 and a plurality of second LEDs 12.

Each of the first and the second LED 11 and 12 is formed of an LED package including a substrate (not shown) and an LED chip (not shown) mounted thereon. The first LED 11 uses an LED chip having a primary wavelength of about 590 nm, thus outputting red light at a color temperature of about 1600 K.

The second LED 12 includes a blue LED chip having a primary wavelength of about 460 nm and a yellow phosphor member (not shown) for converting parts of light from the LED chip 12 into yellow light having a primary wavelength of about 580 nm, thus outputting white light at a color temperature of about 3300 K. The yellow phosphor member is formed of a transparent resin allowing a blue light to be transmitted therethrough (light-penetrating resin) and a yellow phosphor dispersed in the transparent resin. The yellow phosphor absorbs the blue light to be excited, thereby emitting yellow light. That is, parts of the blue light emitted into the yellow phosphor member are converted into yellow light to be emitted therefrom, whereas the remainder of the blue light emitted into the yellow phosphor member passes therethrough without being absorbed by the yellow phosphor and is thus emitted as the blue light. Hence, white light (color temperature≈3300 K) resulting from mixing blue light with yellow light can be obtained from the second LED 12.

Figure 2:
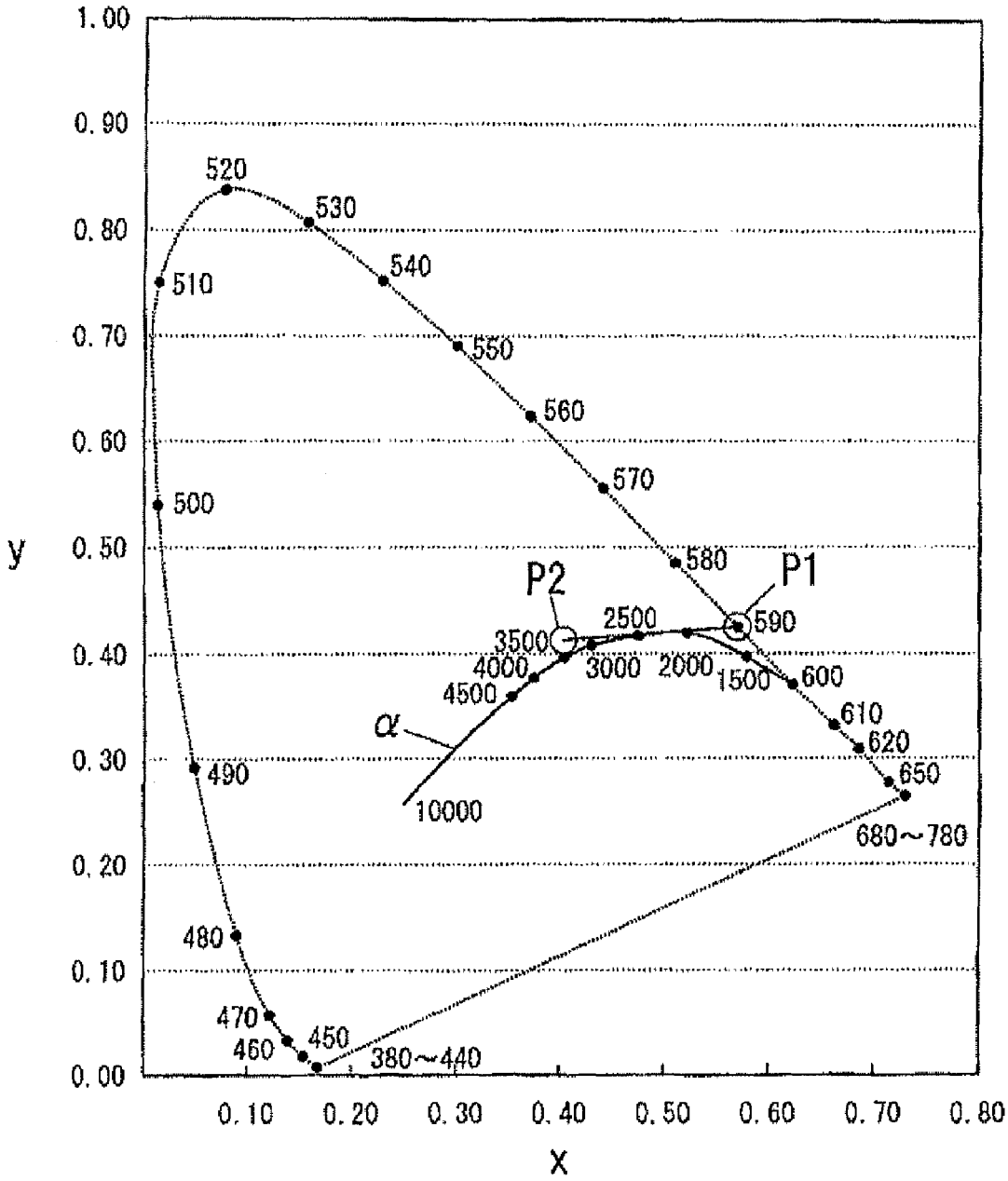
FIG. 2 is a xy chromaticity diagram describing the operation of the light emitting device shown in FIG. 1.

Thus, as shown in the xy chromaticity diagram in FIG. 2, light having a color represented by P1 {(x, y)=(0.58, 0.42)} is emitted from the first LED 11, and light having a color represented by P2 {(x, y)=(0.41, 0.41)} is emitted from the second LED 12. In the xy chromaticity diagram of FIG. 2, the numbers ranging from 380 to 780 indicate the wavelength (nm), and the numbers ranging from 1500 to 10000 indicate the color temperature (K). Thus, the color-mixed light of the first and the second LED 11 and 12 is a light of a color that falls on the straight line connecting the two points P1 and P2 on the xy chromaticity diagram. In the present embodiment wherein the first LED 11 is set to about 1600 K and the second LED 12 is set to about 3300 K, the straight line connecting the two points P1 and P2 approximates the black body locus α on the xy chromaticity diagram. Furthermore, both the two points P1 and P2 are positioned above the black body locus α on the xy chromaticity diagram.

The power supply 2 is configured such that the magnitude of DC voltage (the operating voltage) applied to the light source unit 10 is varied in response to an external dimming signal that represents a dimming level. Changes in the magnitude of output voltage of the power supply 2 results in changes in the current that flows through the current limiting resistor R1. Accordingly, forward current flowing through the first and the second LED 11 and 12 also change, so that the luminous fluxes of the emission lights of the LEDs 11 and 12 change. For example, as the output voltage of the power supply 2 becomes larger, forward currents flowing through the LEDs 11 and 12 increase, and thus, the emission lights of the LEDs 11 and 12 become brighter.

However, the color temperature of the light actually emitted from the light source unit 10 varies between P1 and P2 by the ratio of luminous flux of the first LED 11 to that of the second LED 12. However, if change in forward current depending on a change in the output voltage of the power supply 2 (i.e., voltage-current property) is same in the first LED 11 and the second LED 12, the ratio of luminous flux of the first LED 11 to luminous flux of the second LED could be always constant. Accordingly, the emission light having the color-mixed light of the first LED 11 and the second LED 12 does not depend on the dimming level and the color temperature thereof is rendered constant. In this case, it is impossible to achieve a change in the color temperature of the emission light depending on a change in luminous flux of the emission light (luminous flux-color temperature property) in which the color temperature increases in proportion to an increase in the luminous flux as in an incandescent lamp.

Thus, in the present embodiment, a resistor R2 which is connected in series to the first LED 11 is added to the light source unit 10 so that the ratio of luminous flux of the first LED 11 to that of the second LED 12 is not constant. Hence, the change in the forward current depending on the change in the output voltage of the power supply 2 can be made different in the first LED 11 and the second LED 12, and the luminous flux-color temperature property of the emission light can be controlled as desired.

Specifically, when the resistor R2 is connected in series to the first LED 11 in this way, voltage applied on the first LED 11 is decreased by the amount of voltage drop at the resistor R2 even when the power supply 2 produces the same output voltage as the case where the register R2 is not connected. Hence, in order to flow through the first LED 11 by the same amount of forward current as that when there is not resistor R2, it is required for the power supply 2 to apply to the series circuit of resister R2 and LED 11, a voltage which is higher by the voltage drop at the resistor R2, compared to the case where there is no resistor R2. The magnitude of voltage drop by the resistor R2 is determined by multiplying the forward current of the first LED 11 with the resistance value of the resistor R2. Since the resistor R2 is connected to the first LED 11, the gradient of changes in forward current depending on changes in output voltage of the power supply 2 (voltage-current properties) is decreased. Further, a resistor may be connected in parallel to the LED 11 or the LED 12, so that current applied to the LEDs 11 and the LED 12 can be adjusted.

Figure 3A:
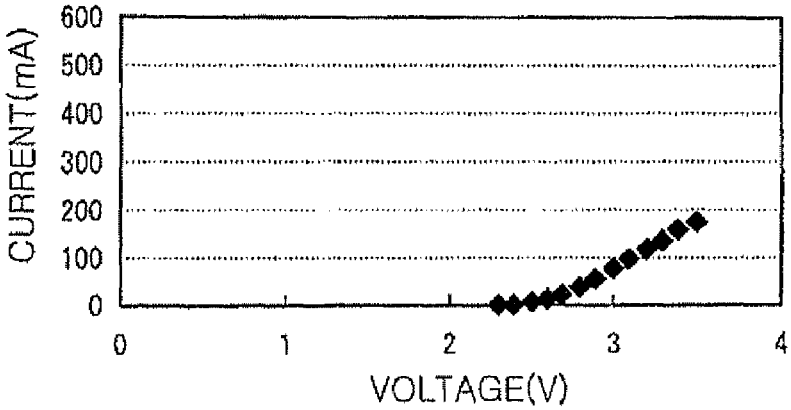
FIG. 3A is a graph showing a voltage-current property of a first LED.
Figure 3B:
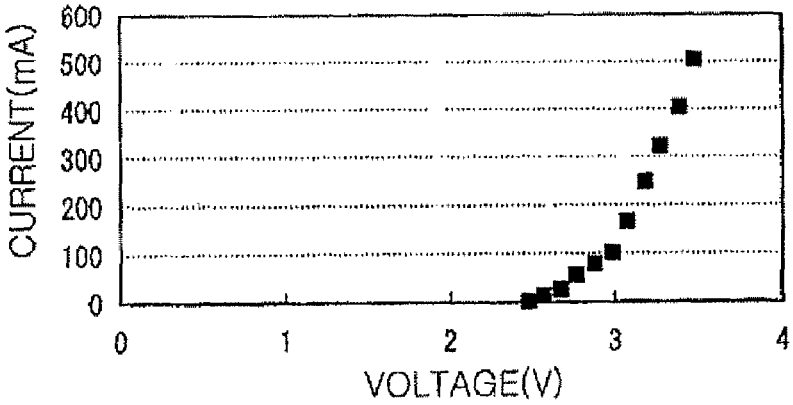
FIG. 3B is a graph showing a voltage-current property of a second LED.

As shown in FIGS. 3A and 3B, the gradient of change in forward current depending on changes in output voltage of the power supply 2 (voltage-current properties) is smaller in the first LED 11 than in the second LED 12. The slope of the voltage-current property in the first LED 11 can be arbitrarily adjusted by the resistance value of the resistor R2. FIG. 3A shows the forward current of the first LED 11 as a function of the output voltage of the power supply 2 set as the horizontal axis, and FIG. 3B shows the forward current of the second LED 12 as a function of the output voltage of the power supply 2 set as the horizontal axis.

Figure 4:
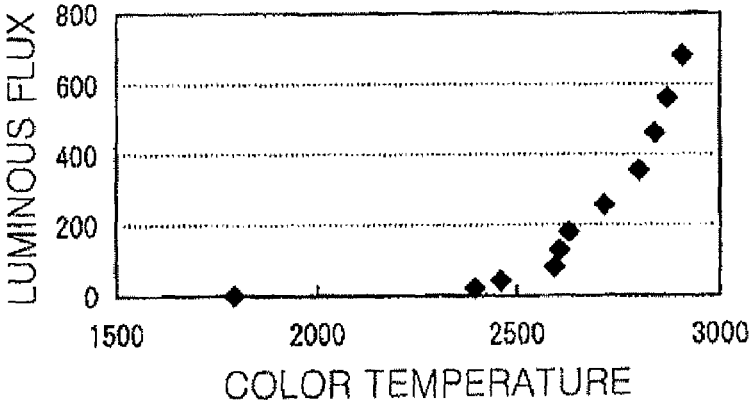
FIG. 4 is a graph showing a luminous flux-color temperature property of the light emitting device shown in FIG. 1.

When the voltage-current properties of the first LED 11 and the second LED 12 are made different in this way, the emission light obtained from the light source unit 10 can have a luminous flux-color temperature property in which the color temperature varies depending on change in luminous flux as shown in FIG. 4. In FIG. 4, the luminous flux-color temperature property of the emission light is depicted, wherein the color temperature is set as a horizontal axis and the luminous flux is set as a vertical axis. Specifically, the magnitudes of forward current of the first LED 11 and the second LED 12 are almost the same in the region in which the output voltage of the power supply 2 is low, and thus the ratio of luminous flux relative to total luminous flux of the emission light becomes almost the same for the first LED 11 and the second LED 12. When the output voltage of the power supply 2 is gradually increased from this state, the ratio of luminous flux of the second LED 12 relative to the total luminous flux of the emission light is gradually increased because of a difference in the voltage-current properties.

The color of the emission light of the light source unit 10 is changed to a color in which the color of light of the second LED 12 is more emphasized in proportion to an increase in output voltage of the power supply 2. In the present embodiment, the color temperature of the second LED 12 is higher than that of the first LED 11, and thus as shown in FIG. 4, the color temperature increases in proportion to an increase in luminous flux (brightness) of the emission light. As the emission light becomes brighter, the color of the emission light becomes closer to P2 on the straight line that connects the two points P1 and P2 in FIG. 2.

In particular, in the present embodiment, the colors of the light of the first and the second LED 11 and 12 are determined so that the straight line that connects the two points P1 and P2 approximates the black body locus α on the xy chromaticity diagram, and thus the luminous flux-color temperature property of the emission light becomes similar to that of the incandescent lamp.

With the simple configuration of the light emitting device 1, in which the resistor R2 is connected in series to the first LED 11, it is possible to get an advantageous effect of the luminous flux-color temperature property of incandescent lamps in which the color temperature varies depending on the change in the luminous flux, even when using the LEDs as a light source.

Also in the present embodiment, since the second LED 12 has the color temperature which is higher than that of the first LED 11, and thus the luminous flux-color temperature property of the emission light becomes similar to that of the incandescent lamp in which the color temperature increases in proportion to an increase in brightness of the emission light. Furthermore, when LEDs including the first LED 11 having a color temperature of 1600 K and the second LED 12 having a color temperature of 3300 K are used, the color of the emission light changes to be in the range from 2000 K to 3000 K along the black body locus α, and thus, the luminous flux-color temperature property of the emission light becomes similar to that of incandescent lamp.

Therefore, when dimming control is performed such that the dimming level of a light signal supplied to the power supply 2 is changed, and therefore, the magnitude of DC voltage applied to the light source unit 10 is changed, the color temperature of the emission light obtained from the light source unit 10 changes as it does in the incandescent lamp. Hence, even in the case where the incandescent lamp and the light emitting device 1 using the LEDs are employed together in the same place, the color temperatures of the incandescent lamp and the light emitting device 1 can be matched without creating the sense of incongruity.

However, in order to achieve the luminous flux-color temperature property similar to that of the incandescent lamp as mentioned above, it is preferred that the LED 11 having the lower color temperature has a lower turn-on voltage (output voltage of a power supply 2) than the other LED 12. In such a case, if the output voltage of the power supply 2 is gradually increased by the dimming control, the LED 11 having the lower color temperature is turned on first, and the LED 12 having the higher color temperature is turned on thereafter, whereby the color temperature of the emission light is increased as the luminous flux is increased.

Thus, LEDs having different forward voltages are selected as the first and the second LED 11 and 12 such that the LED 11 having the lower color temperature is turned on first at a lower forward voltage. For example, as shown in FIGS. 3A and 38, the first LED 11 begins to be turned on at an output voltage of the power supply 2 of 2.3 V, and the second LED 12 begins to be turned on at an output voltage of the power supply 2 of 2.5 V. Resultantly, when the dimming level is gradually increased, the first LED 11 having the lower color temperature is turned on first, after which the second LED 12 is turned on, whereby the color temperature of the emission light is increased.

Further, in this embodiment, in order to achieve the luminous flux-color temperature property similar to that of the incandescent lamp, the first LED 11 having the color temperature of 1600 K and the second LED 12 having the color temperature of 3300 K are described, but these temperatures are merely illustrative and the present embodiment is not limited thereto. Further, it is possible to use, as the first LED 11, an LED having a higher color temperature than that of the second LED 12. Furthermore, forward voltages of both the LEDs 11 and 12 may be matched so that the first LED 11 and the second LED 12 are simultaneously turned on, when the output voltage of the power supply 2 is gradually increased.

While the invention has been shown and described with respect to the particular embodiments, it will be understood by those skilled in the art that various changes and modification may be made without departing from the scope of the invention as defined in the following claims.

What is claimed is:

1. A light emitting device, comprising:

a light source unit which includes a first and a second light emitting diode (LED) which are connected in parallel to each other and emit lights of different colors, respectively, wherein the lights of the first and the second LED are mixed to provide an emission light of the light source unit when an operating voltage is applied, and wherein the light source unit further includes a resistor which is connected in series to the first LED to make forward current changing characteristics of the first and the second LED depending on change in the operating voltage to be different from each other, so that a required luminous flux-color temperature property, in which change in a color temperature of the emission light is made to depend on change in a luminous flux of the emission light, is obtained while the first and the second LED are turned on by applying the operating voltage.

2. The light emitting device of claim 1, wherein the color temperature of the second LED is higher than that of the first LED so that the color temperature of the emission light of the light source unit increases as the emission light becomes brighter.

3. The light emitting device of claim 2, wherein the first and the second LED emit a red and a white light, respectively.

4. The light emitting device of claim 1, wherein, among the first and the second LED, an LED having a lower color temperature has a lower turn-on voltage than the other LED having a higher color temperature.

5. The light emitting device of claim 2, wherein, among the first and the second LED, an LED having a lower color temperature has a lower turn-on voltage than the other LED having a higher color temperature.

6. The light emitting device of claim 3, wherein, among the first and the second LED, an LED having a lower color temperature has a lower turn-on voltage than the other LED having a higher color temperature.

* * * * *